United States Patent [19]

Nickipuck

[11] Patent Number: 4,938,107

[45] Date of Patent: Jul. 3, 1990

[54] WEDGE LOCKING SOCKET DEVICE

[75] Inventor: Michael F. Nickipuck, Brookfield, Ill.

[73] Assignee: 501 Qualicorp, Ltd, Westmont, Ill.

[21] Appl. No.: 235,287

[22] Filed: Aug. 23, 1988

Related U.S. Application Data

[63] Continuation-in-part of Ser. No. 45,781, Nov. 6, 1984, Pat. No. 4,768,405, which is a continuation-in-part of Ser. No. 634,775, Jul. 26, 1984, abandoned, which is a continuation-in-part of Ser. No. 260,350, May 4, 1981, Pat. No. 4,480,511.

[51] Int. Cl.[5] ..... B25B 23/16

[52] U.S. Cl. ..... 81/177.85; 403/365

[58] Field of Search ..... 81/177.85, 53.2, 124.4, 81/439, 177.4, 177.2; 279/2 R, 75, 76; 403/365, 367

[56] References Cited

U.S. PATENT DOCUMENTS 4,768,405 9/1988 Nickipuck ..... 81/177.85

*Primary Examiner*—Frederick R. Schmidt
*Assistant Examiner*—M. Rachuba
*Attorney, Agent, or Firm*—Myers & Ehrlich

[57] ABSTRACT

A socket wrench drive extension incorporates a quick release and locking feature. The extension is used in conjunction with a ratchet drive and standard mechanics sockets for driving threaded fasteners. The extension uses a longitudinal control bar which bears directly or indirectly on a detent contained in a transverse bore at the driving end of the extension. The control bar fits in a channel on the exterior of the extension and is operated through the retraction of a spring loaded collar.

22 Claims, 3 Drawing Sheets

WEDGE LOCKING SOCKET DEVICE

BACKGROUND OF THE INVENTION

This is a continuation in part of my application Ser. No. 07/045,781 , filed Nov. 6, 1984, now issued as U.S. Pat. No. 4,768,405 on Sept. 6, 1988, which is a continuation-in-part of Ser. No. 634,775, filed July 26, 1984 now abandoned, which is a continuation-in-part of Ser. No. 260,350, filed May 4, 1981, now U.S. Pat. No. 4,480,511 issued Nov. 6, 1984 which are incorporated by reference herein.

In summary my tools are designed to provided advantages of ease of operation, increased utility, ease of maintenance and better value for products used in the typical environment of the mechanic, particularly the automotive mechanic. Earlier embodiments of my inventions involved in part arrangements which could be utilized to effectuate the locking of a drive socket to my tool and the release of that socket for removal or replacement.

My present embodiments utilize alternative arrangements of the elements so as to enhance the utility and ease of operation of the tool. Through the co-action of the various elements in these improvements several additional goals can be accomplished in addition to those discussed in my prior applications and patent. The first of these improvements utilizes the camming engagement of a series of retainer balls and a novel camming control bar to provide wedging between the bar and balls for effectively locking an associated socket. The second improvement uses the placement of a spring co-acting with the retainer balls so as to prevent loss of an associated socket upon accidental release of the locking sleeve. The third improvement utilizes a lock-back mechanism to increase the ease of placement of the socket on the tool. A fourth embodiment uses a securement portion as a separate structure from an extension shank. A fifth embodiment uses a notched control bar to provide for semi-automatic retraction.

The advantage in the use of a camming control bar is that the forces contributing to retention are increased under load. Another advantage is that engagement with a recess in a socket is less important that in any prior embodiments.

An advantage in the use of a spring co-acting with retainer balls is that a degree of increased friction is imparted between the drive extension and the socket walls even in the released position.

An advantage to the lock-back mechanism and the notch control bar embodiment are that either provides a degree of semi-automatic action in the retraction.

DETAILED DESCRIPTION OF THE PREFERRED EMBODIMENT

Figure 1:
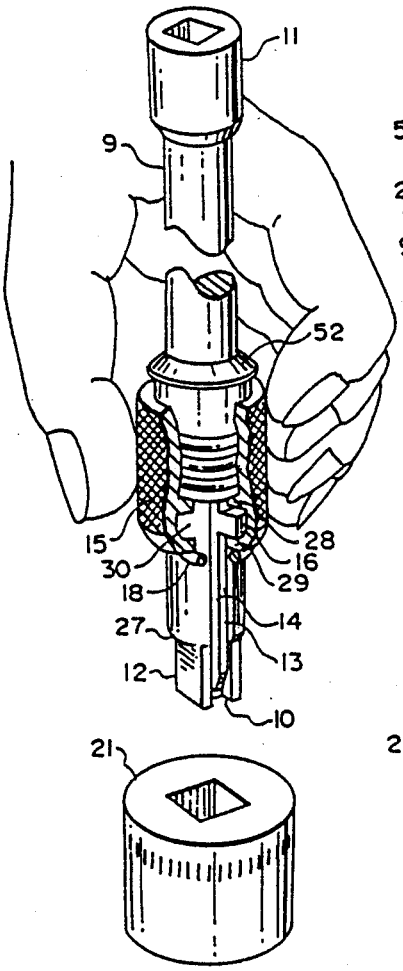
FIG. 1 is a perspective cut away view of my socket locking extension.

FIG. 1 illustrates a socket locking extension with a driven portion (11) extension shank (9) and square driving portion (12). The driving portion (12) fits into socket (21) for imparting rotational movement.

The shank (9) terminates at a shoulder (27) at the end of the shank (9). A slot or channel (10) is formed in the surface of the shank and extends into one face or wall of the drive portion (11).

A control bar (14) which has an outer surface (13) is carried in the control bar channel. A raised portion or spur (16) extends outward from the outer surface (13) and fits into sleeve (15). The sleeve has internal annular engagement elements or flanges. In this embodiment these constitute an inner annular ring (28) and terminal annular ring (29) of the sleeve defining an annular groove (30) between them. This preferred embodiment does not foreclose the use of other methods of engagement. The forward motion of the sleeve toward the driving end is limited by a circular clip (18) as in prior embodiments. Rearward movement, however, is limited by a limiting collar (52) which engages the rear edge of the sleeve. In the preferred embodiment the sleeve may be covered with a friction increasing surface pattern such as knurling or other arrangements making the sleeve easy to grip and retract.

Figure 2:
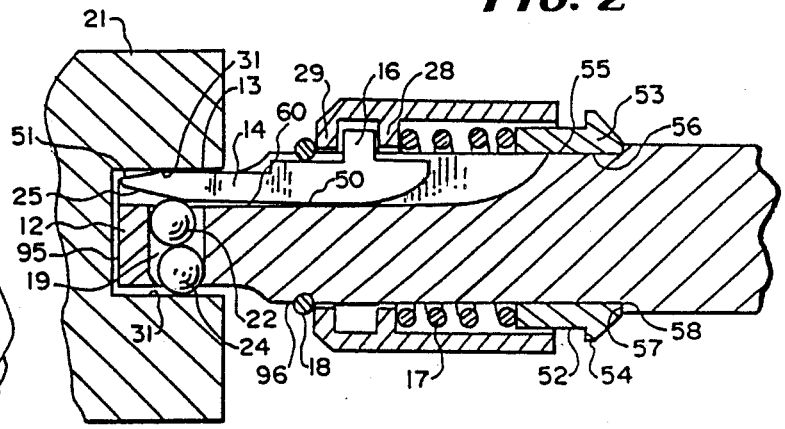
FIG. 2 is a sectional view of one embodiment of the improved socket locking extension in the locked position.

FIG. 2 is sectional view of the preferred embodiment. The socket (21) has a plurality of faces (31) which engage the drive portion (12). Apparent in this view is a transverse bore (19) in which retainer balls (22) and (24) are carried. The clearances between the retainer balls and bore are such that a slight off center condition results in a camming action. The control bar (14) carried in the control bar channel (10) extends forward or toward the distal end 95 (to the left). The outer surface (13) of the control bar engages the socket surface (31) when in the locked position. The inner surface (50) of the control bar slides on the floor (60) of the channel (10). The inner surface (50) merges into a bevel (25). It has been found in development that a bevel angle of approximately 10 degrees is preferable in this embodiment. For improved clearance and engagement of the socket, the tip of the control bar is also beveled (51) adjacent to the outer surface (13).

Further apparent in this view are the sleeve-control bar engagement elements (28) and (29) which engage the outwardly extending spur (16) of the control bar permitting retraction and imparting a forward (leftward) force through the action of a compressed coil spring (17). As noted in connection with FIG. 1 forward and radially outward motion is limited by circular clip (18) snapped into groove (96) in the shank although other appropriate structures may be used.

Figure 3:
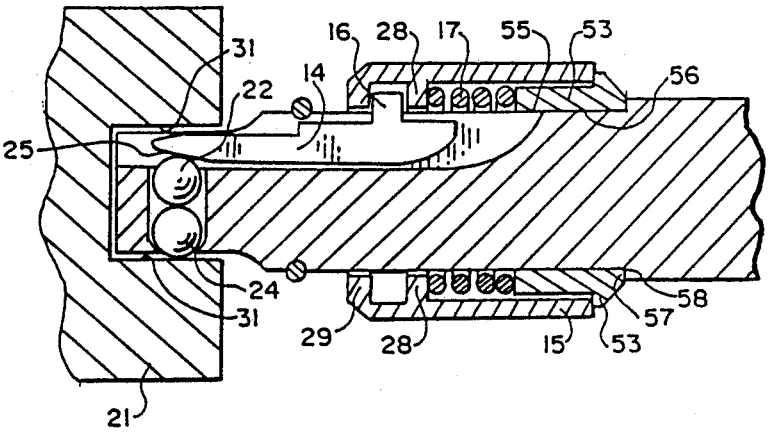
FIG. 3 is a sectional view of one embodiment of the improved socket blocking extension in its released position.

As shown in FIG. 3, the spring (17) is compressed between the engagement element (28) of the sleeve in the limiting collar (52) and an opposing edge of the limiting collar. The limiting collar itself is carried on the shank and has an inner surface (55) carried on a reduced diameter shank surface (56). The end of the limiting collar (57) engages a shoulder (58) formed at the intersection of the reduced diameter surface (56) and outer surface of the shank. The limiting collar further incorporates an outwardly extending shoulder (54) formed around its circumference which engages the rearward end (53) of the sleeve (15) at the rearward most extension of travel. This in turn retracts the control bar (14) and the retainer balls (22) and (24) are permitted by the movement of the bevel (25) to disengage from the socket face (31).

Figure 5:
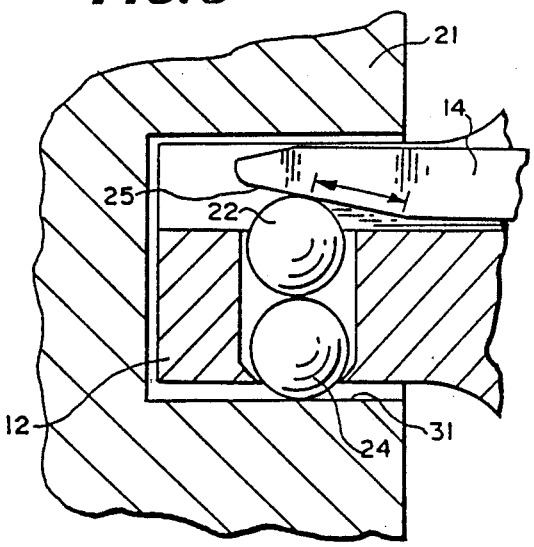
FIG. 5 is an enlargement of the embodiment in FIG. 3

As shown in FIG. 5 the distance of travel permitted is less than the horizontal distance between the tip of the control bar (51) and the point where the bevel (25) merges into the inner control bar surface (50). As a result of this arrangement in the locked position the retainer ball (22) continues to engage the bevel surface (25). This may be compared to my patent No. 4,480,511 where the forward travel of the control bar and rearward travel of the control bar was such that the flat surface engaged the retainer ball.

Figure 4:
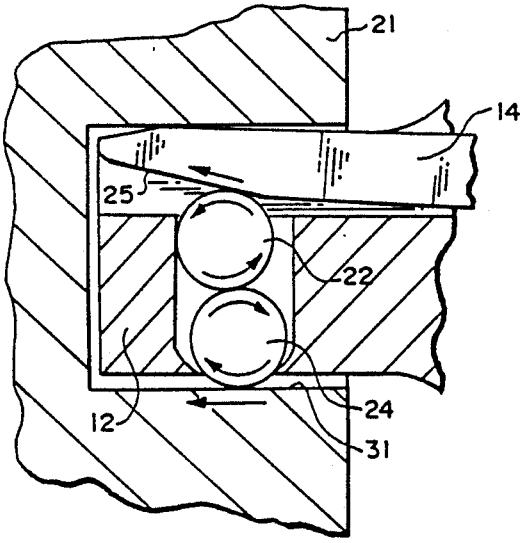
FIG. 4 is an enlargement of the embodiment in FIG. 2

As shown in FIG. 4 there are several advantages to this arrangement. In the environment where the tool is likely to be utilized and given the typical dimensions and clearances of standardized sockets, the sockets frequently become canted, twisted and otherwise misaligned under the forces exerted thereon. This may result in the jamming of the tool rendering it difficult to the release the socket. Engagement of the retainer ball (22) cooperating with the socket engagement retainer ball (24) on the bevel surface (25) reduces the tendency to jam. Even slight retraction of the control bar (13) necessarily reduces the transverse dimension between the outer surface of the control bar and the outermost point of the retainer of the retainer ball (24) thereby reducing any transverse pressure across the tool. The increased ease of release permits the use of closer tolerances in the tool which permit improved gripping force because of the coacting of rotational and wedging forces in the respective components. When a socket engaging the retainer ball (24) and control bar outer surface (13) on opposite walls is pulled forward (leftward) friction from the wall which engages the retainer ball (24) will tend to impart a rotation clockwise as shown by the arrows in FIG. 4. Near the point of tangency (considering the slight off center alignment of the balls) and near the point diametrically opposed thereto, the retainer ball (24) engages the other retainer ball (22). The rotation of the first ball (24) imparts a counter clockwise rotation in the second ball (22) also shown by arrows. A lateral force is transferred to the control bar bevel or wedging edge (25) and tends to impart a forward (leftward) motion to the control bar as shown by the arrow. This movement of the bar, because of the bevel arrangement, tightens the engagement of the retainer ball (24) with the control bar surface. Thus the bar is tightly wedged between the ball (22) and socket walls. The opposing surface (31) develops a tight frictional fit resisting the pulling of the socket off the tool in its locked position because of the radial expansion of the assembly.

This permits the utilization of sockets whose interior walls do not have the recesses designed to engage retainer balls (24) which were noted in prior art and my earlier inventions. In the field this provides increased utility as sockets may become worn, sockets may be produced with recesses on none of their interior walls (31) or sockets may be produced with recesses or equivalent structures on less than all of the walls as in the case of impact sockets. In this later instance a retainer ball expected to engage a recess would only engage the socket if a transverse hole extending from the outer surface of the socket through to the interior surface of socket is lined up with the retainer ball. This becomes cumbersome in the field and the present improved configuration permits the locking of said sockets even when flat walls are engaged by the retainer ball (24) and outer control bar surface (13).

Figure 6:
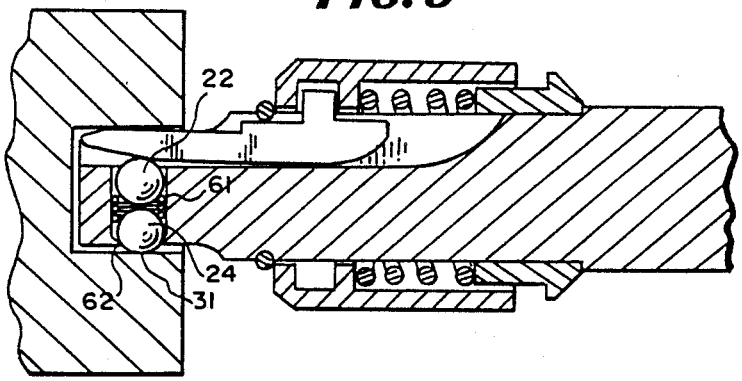
FIG. 6 is a sectional view of another embodiment of the improved socket locking extension in its locked position.

FIG. 6 corresponds to FIG. 2 with the addition of a helical spring (61) interposed between the retainer balls (24) and (22). While in the released position the retainer balls are essentially free to move inward and outward within limits. A reduced diameter (62) of the transverse bore limits outward movement in a direction opposite the control bar and movement toward the control bar is limited either by the control bar itself or by reducing the diameter by machining flanges or tapering the bottom of the transverse bore during drilling and before machining the control bar channel. This loose carriage of the retainer balls provides essentially negligible resistance to the forward movement of the socket.

Figure 7:
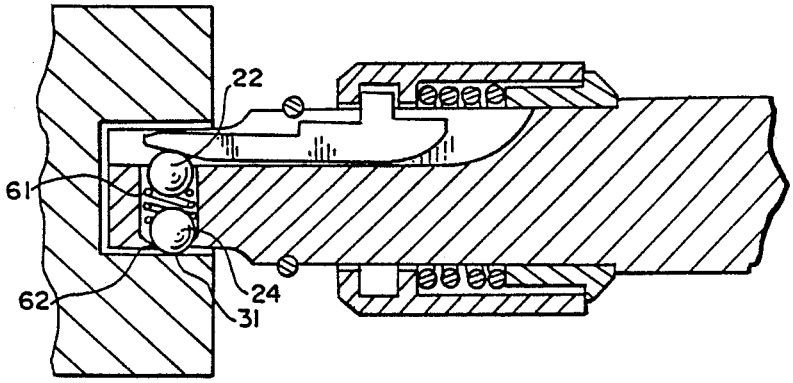
FIG. 7 is a sectional view of another embodiment of the improved socket locking extension in its locked position device.

In FIG. 7 it is shown that the placement of the spring exerts an outward force on the retainer balls. This outward force provides for increased resistance against the wall of or recess in the wall of the socket thereby reducing the likelihood of the socket falling off the tool when the control bar is retracted in the released position, either intentionally or accidently.

As illustrated in FIGS. 4 and 5 the relative dimensions of retainer balls, spring and transverse bore diameter are such that in the locked position the retainer balls bear directly on one another resulting in the rotational and wedging action discussed with reference to the previous Figures. The spring diameter is nearly equal to that of the bore and in the locked position the spring is nearly fully compressed so that any deformation of the balls permits a fully compressed spring to bear some of the load. The use of the bevel or wedging surface engagement described with reference to FIG. 2, FIG. 3, FIG. 4 and FIG. 5 and the use of the spring described in connection with FIG. 4 and FIG. 5 provide the highest degree of utility in use.

Figure 8:
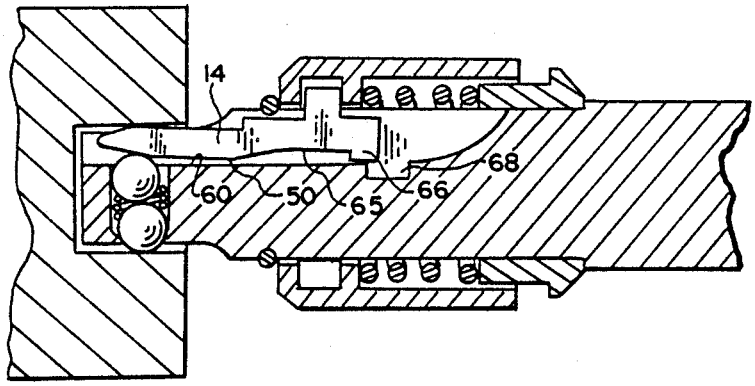
FIG. 8 is a sectional view of another embodiment of the improved socket locking extension in its released position device.

FIG. 8 shows a sectional view of another embodiment. This view is analogous to FIGS. 2 and 4 which show the device in the locked position. It will be noted toward the rear (right) end of the control bar (14) the control bar bottom surface (50) has been notched (65). Rearward (to the right) of the notch is a downwardly projecting latch element (66) terminating along an extended imaginary line from the control bar bottom surface (50). A second transverse bore (68) which may constitute a blind bore extending partially downward from the control bar channel floor (60) is shown.

Figure 9:
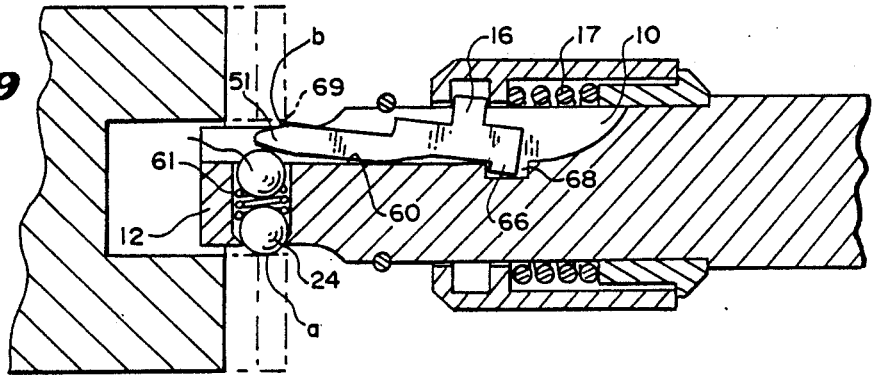
FIG. 9 is a sectional view of another embodiment of the improved socket locking extension in its locked position device.

FIG. 9 shows this embodiment of the tool in the released position. The spring (61) acting through retainer ball (22) exerts an upward force on the tip of the control bar. This and the placement of the recess (68) in the channel floor (60) permits the downward biasing of the rear end of the control bar and corresponding upward biasing of the tip of the control bar. The downward biasing results in the engagement of the latching element (66) in the recess (68). Thus the mechanism is latched in the open position in this embodiment. This may be compared to other embodiments where the spring (17) always returns the mechanism to the locked position thus requiring retraction both to remove and to place a socket on the driving and (12) of the tool. Release of the mechanism from its latch position is accomplished by the forcing of retainer ball (24) against spring (61) at point "a", permitting further insertion of the socket. Then the socket end (69) engages the tip bevel (51) of the control bar when the socket is further moved on the tool at point "b" of FIG. 9. The angle of this permits unlocking of the control bar by causing the downward biasing of the tip and corresponding upward biasing of the rear end of the control bar to the point where the latch element (68) disengages from the recess (68). The pressure of the spring (17) thereby locks the mechanism. This provides semi-automatic action by holding the control bar in a socket release position until replacement of a socket causes locking action.

Figure 10:
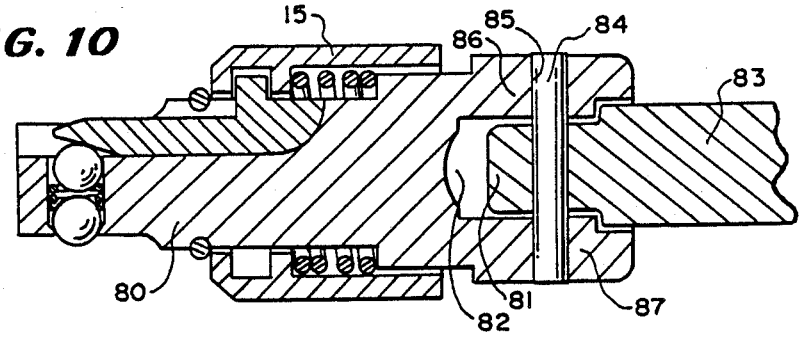
FIG. 10 is a sectional view of an embodiment in which a separate securement structure is attached to a drive shank.

FIG. 10 shows an alternative embodiment of my invention. In this embodiment the securement portion of the tool is carried on a truncated body (80) of length limited to that necessary carry the sleeve (15), provide for the stop limiting retraction of the sleeve and is adapted to receive the driving end (81) of a second shank in corresponding recess (82) in the truncated body. Operation of the retainer mechanism is otherwise unchanged from the alternative embodiments previously discussed. The recess for driving the truncated body by the second shank (83) is defined by walls that correspond to the driving portion (81) of the second shank (83).

The truncated body (80) is further attached to the second shank (83) in a semi-permanent manner through the insertion of a pin (84) in a hole (85) extending through one wall (86) of the truncated body's recess, through the driving portion (81) of the second shank (83) and through the opposing wall (87) of the driven recess of the truncated body. This pin may be inserted and maintained in place by a compression fit thereby resulting in a unitary extension tool. Alternatively a spring loaded pin permits adaptation to power driven extensions.

Figure 11:
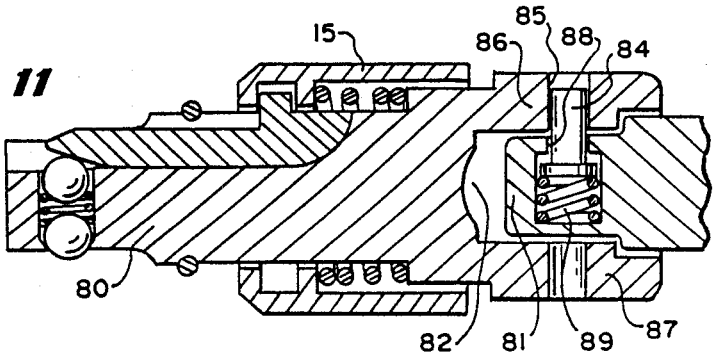
FIG. 11 is a sectional view of an embodiment similar to that of FIG. 10, using a different connection between the shank and the truncated body.

FIG. 11 shows an alternative truncated body arrangement. In this arrangement the pin (84) is carried in a hole (88) in the driving portion 81 of the second shank (83). In this case the pin (84) is of a rivet head or inverted "T" shaped section and the neck of the hole (85) is reduced in diameter to retain the pin. A spring (89) forces the pin outward and this permits easier removal by depressing the pin (85) with a suitable implement such as a probe, punch or the like. This is considered a semi permanent affixation because of the retention of the pin and need for an implement to remove the truncated body (80).

The use of the arrangement in FIGS. 10 and 11 permits the use of dissimilar alloy metals in the truncated body and second shank, the use differential treatment as by heat treating of the respective truncated body and second shank and repair of either the truncated body or the second shank without requiring replacement of both. A further advantage is that production can be streamlined because of the previous mentioned material and heat treatment flexibility. Further, the truncated body-second shank arrangement permits adaptation of various length extensions which may be more easily conformed to specific consumer needs.

Figure 12:
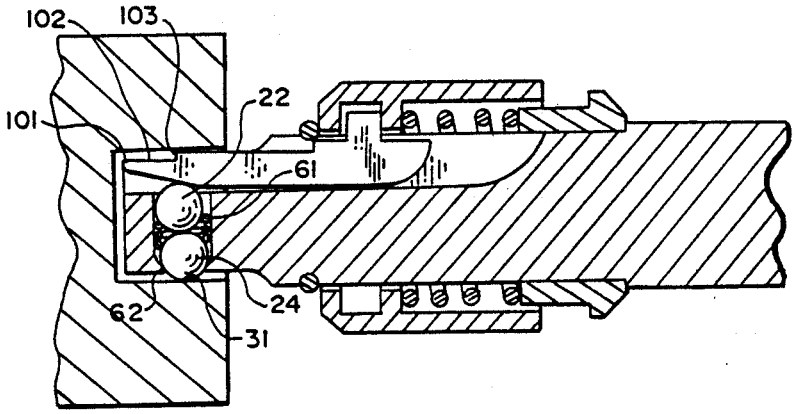
FIG. 12 is a sectional view of an embodiment which provides semiautomatic retraction.
Figure 13:
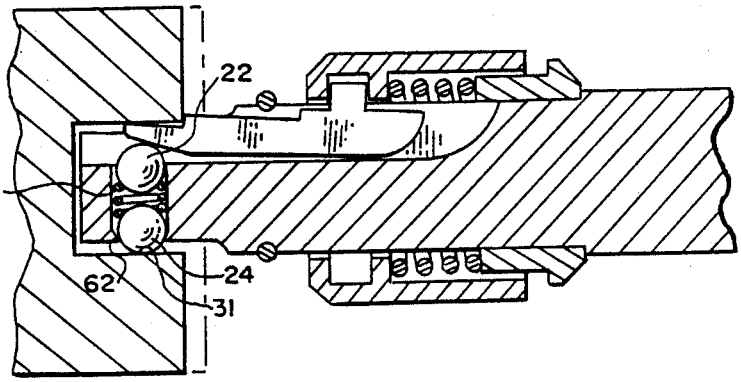
FIG. 13 is a sectional view of the embodiment of FIG. 12, with the control bar partially retracted.

FIG. 12 and FIG. 13 shows another embodiment which provides semi automatic retraction. In this embodiment the control bar (14) has a recess (101) which defines a stepped engagement portion placed in its tip (51). This recess includes a face (102) substantially parallel to the axis of the control bar (14) and forms a escapement shoulder (103) perpendicular thereto. The shoulder is placed at such a position that as a socket is installed, the retainer balls are forced upward and the control bar tip (51) is biased upward so that it engages the base of the socket. Continued movement of the socket causes partial retraction of the control bar (14) against the pressure of the spring (17). The socket (31) moves rearward (to the right) to the point where there is sufficient clearance between the opposing walls (31) because of the reduced transverse dimension across the bevel (25) that the control bar (14) may move to the locked position.

In accordance with my invention I claim:

1. In a tool for securement to socket members having variously spaced walls defining securement openings, a tool having a securement structure for entry and withdrawal with respect to said openings for connecting and disconnecting such socket members for rotation therewith comprising:

a first shank member adapted to be selectively entered within the securement opening;

a control bar member supported on the shank member for forward and retracting longitudinal movement with respect thereto to a locked position and a retracted release position and for generally radial movement on the shank member toward and away from an adjacent wall of a socket member for locking engagement therewith and release therefrom;

detent means supported on the shank member for movement transversely with respect thereto for selectively securing and releasing said shank member through said control bar member with respect to said socket member;

said control bar member having an outward surface facing generally away from the shank member and an acutely angled inward wedging surface facing the shank member;

said inward surface of the control bar member continuously wedgingly engaging the detent means when the control bar member is moved into the locked position to move and maintain said detent means against a first wall of the socket member for securing the socket member in engagement with the shank member;

the control bar member moving generally radially outwardly from the shank member and said outward surface of the control bar member contacting another of the wall portions of the socket member within the opening therein coincident with the inward wedging surface wedgingly moving the detent means to engage the first of the inner wall portions, whereby the socket member is generally centered on and secured to the securement structure;

said detent means being expandable radially between said first wall of the socket and said control bar and the wedging moving the control bar generally radially outwardly attendant to the socket member tending to move longitudinally in a disconnecting direction relative to the first shank, 2. The invention according to claim 1, and wherein said detent means comprises a pair of retainer balls cammingly engaging each other when said socket is to be moved in a disconnecting direction relative to the shank and rotatably imparting the wedging of the control bar.

3. The invention according to claim 2, and wherein said shank member has a driven end socket adapted to receive a driving element.

4. The invention according to claim 3, and forward and retracting movement limiting means and sleeve means on the shank member and said forward movement limiting means limiting said forward movement of the sleeve relative to the shank, and said retracting movement limiting means limiting said retracting movement of said sleeve relative to the shank;

said control bar being movable radially inwardly and outwardly, the radial outward movement being limited by said sleeve, and means providing a recessed surface in said shank member, said recessed surface means limiting radially inward movement of the control bar.

5. The invention according to claim 4, and a driving element associated with the driven end of the shank;

said driving element comprising a second shank member with driving means complemental to said driven end of said first shank member; and said second shank member being attached to said first shank member at the driven end.

6. The invention according to claim 4, and detent biased engagement means for holding said control bar member in partial engagement with said socket member in a position facilitating disengagement of said engagement means from said socket member to and extending said control bar member into the locked position.

7. In a tool for securement to socket members having variously spaced walls defining a securement opening, a tool having a securement structure for connecting and disconnecting such socket members for rotation therewith comprising:

a shank for holding said socket member and imparting rotation thereto;

detent means in the shank for engagement with one of said walls;

a control bar longitudinally movable and moving the detent means between locking and unlocking engagement with said wall as said control bar moves longitudinally between a locking and retracted position;

guide means on the shank for guiding the control bar;

said control bar and said shank having engagable and disengagable latch means and said control bar being engagable with said latch means when in a retracted position and disengagable upon sleeving of said socket member on said shank.

8. Driving means for use with a socket member having a securement opening therein defined by opposed walls, said driving means having a securement structure comprising:

a first shank member positionable within said securement opening;

a sleeve member on this shank member having locked and released positions;

detent means supported for axial and radial movement in an opening in the shank member;

a control bar supported on the shank member for movement longitudinally thereof and having a wedging surface engaging said detent means;

said wedging surface having a longitudinal movement component larger than the longitudinal range of movement of said bar;

said wedging surface being in continuous engagement with said detent means in all operative positions of said bar for engaging said detent means with one wall of the socket member while the control bar is engaging an opposite wall of the socket and said sleeve in in the locked position.

9. The invention according to claim 8, and wherein said detent means comprises two retainer balls positioned to cammingly engage each other, one of said balls engaging the control bar and the other engaging the wall of said socket member opposite the control bar.

10. The invention according to claim 9, and said first shank member having a driven end with walls defining a recess adapted to receive a driving element.

11. The invention according to claim 10, and said first shank member is adapted to carry first and second movement limiting means and sleeve means and recessed surface means;

said control bar having a tip and being longitudinally forwardly and rearwardly movable to advance and retract said tip;

said forward movement being limited by said first movement limiting means and rearward movement limited by said second movement limiting means; and said control bar being radially movable with its radially outward movement limited by said sleeve means and its radially inward movement limited by said recessed surface.

12. The invention according to claim 11, and said driving element comprising a second shank member with driving means corresponding to said driven end of said first shank member; and said second shank member being attached to said first shank member.

13. The invention according to claim 11, and socket engagement means at the tip of the control bar;

said control bar being moved longitudinally by engagement of said socket member with said engagement means, the corresponding longitudinal movement of the socket thereby retracting said control bar; and said socket member having retainer clearance means permitting disengagement of said engagement means from said socket member when a predetermined point of longitudinal movement of the socket member relative to the retainer means is reached.

14. The invention according to claim 11, and wherein said control bar has first latch means and said shank has second latch means;

said control bar being engagable and disengagable by the corresponding engagement and disengagement of said first and second latch means.

15. For use with a socket member having a wall defined securement opening, a securement structure comprising:

a first shank member adapted to extend within said securement opening and having a perimetrical surface;

a control bar supported on said first shank member adjacent to the perimetrical surface;

said first shank member having longitudinal guide means extending through said surface;

a control bar in said guide means and slidable with respect to said first shank;

retention means holding the control bar on the first shank and permitting Longitudinal and limited radial movement of the control bar with respect to the first shank member;

detent means supported on the first shank member and extendible through said surface for selective movement between a locked and release position;

said detent means extending in the locked position to engage one of two opposing walls of said socket member, thereby securing the socket member on the first shank;

said detent means in the release position being withdrawn from said engagement to permit removal of the socket member from said first shank;

said control bar having wedging means wedging with the detent means and moving said detent means into said locked position when the control bar is moved into the locked position;

said wedging means being cooperative with said detent means beyond the limit of movement of said bar to locked position.

16. The invention according to claim 15, and said detent means comprising two retainer balls reactively disposed between said bar and an opposing socket wall.

17. The invention according to claim 16, and said first shank member having a driven end with walls defining a recess adapted to receive a driving element.

18. The invention according to claim 17, and said first shank member having front and rear ends, and first and second motion limiting means and sleeve means carried on the shank member; and said control bar being movable longitudinally with forward motion limited by said first motion limiting means and rearward motion limited by said second motion limiting means; and said control bar being movable radially with radially outward movement limited by said sleeve means and radially inward movement limited by a recessed surface in said first shank member.

19. The invention according to claim 18, and said driving element comprising a second shank member with driving means corresponding to said driven end of said first shank member; and said second shank member being attached to said first shank member.

20. The invention according to claim 18, and said control bar having stepped socket engagement means said control bar being moved longitudinally by engagement of said socket member with said stepped engagement means retracting said control bar; and said socket member having retainer clearance means permitting disengagement of said engagement means from said socket member.

21. The invention according to claim 18, and wherein said control bar has first latch means and said shank has second latch means;

said control bar being engagable and disengagable by the respective engagement and disengagement of said first and second latch means for maintenance of the control bar in the release position when engaged, and for movement to the locked position when disengaged.

22. Means for facilitating coupling of a driving shank with a socket wrench having an inner end and a shank receiving cavity with an axially extending side wall therein;

radially expandable detent means mounted on one end of the shank;

a control bar slidably supported on the shank for movement longitudinal to the shank and movable radially thereof in opposition to the detent means;

said bar having a narrow leading end portion and a wider adjoining portion defining a stepped outer edge with an intervening escapement shoulder surface;

means for biasing said control bar for urging it endwise toward the adjacent end of the shank for initially wedging said narrow portion between said cavity wall and said detent means in a first position and engaging said escapement shoulder with said inner end of the socket wrench;

said escapement shoulder formed and arranged to escape under said wall attendant to the shank and socket being pressed toward each other and forcing said wider portion of the control bar into the cavity.

* * * * *